United States Patent [19]

Jiminez

[11] 4,102,531

[45] Jul. 25, 1978

[54] METHOD OF AND APPARATUS FOR FOLDING A SHEET TO FORM PAGES OF VARIABLE FORMAT

[75] Inventor: Pedro Jiminez, Evry, France

[73] Assignee: Ateliers de Constructions Mecaniques Seailles et Tison, Evryl-Ville-Nouvelle Ris-Orangis, France

[21] Appl. No.: 762,215

[22] Filed: Jan. 24, 1977

[30] Foreign Application Priority Data

Mar. 4, 1976 [FR] France ..... 76 06124

[51] Int. Cl.[2] ..... B65H 45/20

[52] U.S. Cl. ..... 270/79; 270/61 F; 270/73

[58] Field of Search ..... 270/79, 61 F, 73; 229/104–107

[56] References Cited

U.S. PATENT DOCUMENTS

| | | | |
|---|---|---|---|
| 3,544,099 | 12/1970 | Cooke | 270/79 |
| 3,784,188 | 1/1974 | DeLigt | 270/79 |

*Primary Examiner*—Edgar S. Burr
*Assistant Examiner*—A. Heinz
*Attorney, Agent, or Firm*—Pollock, Vande Sande & Priddy

[57] ABSTRACT

An elongate sheet to be folded into pages is fed to a folding station where parts of the sheet at intervals along its length are successively engaged by grippers to form upwardly directed folds therein and intermediate parts of the sheet are formed into downwardly directed loops. The folded and looped sheet is then advanced by the grippers to a delivery station. During this advance, the loops are flattened to form intermediate folds by engaging a conveyor belt moving more slowly than the grippers. At the delivery station the grippers open to release the folded sheet.

8 Claims, 2 Drawing Figures

1
2
4
4
6
7
8
9
10
13
16
17
18
19

METHOD OF AND APPARATUS FOR FOLDING A SHEET TO FORM PAGES OF VARIABLE FORMAT

The invention relates to a method of and apparatus for folding a sheet to form pages and which enable the format of folding to be varied without making adjustments or mechanical alterations which would necessitate stopping the operational cycle of the folding apparatus.

The invention applies in particular to the folding of printed matter delivered by a machine which includes a registration adjustment mechanism which allows the position of a fold line to be varied as a function of the format to be produced.

Furthermore, it applies in particular to machines which include an intermittent drive so that the sheet is advanced step-by-step.

In the method according to the invention a series of folds to be located along corresponding first edges of the pages is formed by successively gripping part of the sheet at intervals along its length and in which the folds thus formed are advanced and compressed one against the other in order to form intermediate folds to be located along corresponding second edges of the pages on the opposite sides of said pages from said first edges. Thus, only every second fold is formed positively, the intermediate folds being obtained as a result of compression.

Preferably, when the first-mentioned folds are made, a reversed ogival form is given to those parts of the sheet which are included between the first-mentioned folds.

In a simple embodiment, the first-mentioned folds are compressed by laying them flat on a conveyor belt moving with a speed of displacement less than the speed of displacement of said first-mentioned folds.

The invention also includes a folding apparatus for folding a sheet into pages by the above method, which apparatus comprises a series of grippers, means for advancing said grippers along an endless track, means for opening the grippers at a fold-forming station, means for pushing the sheet into the open grippers at said fold-forming station, means for closing the grippers again on to the sheet in order to form the first-mentioned folds, means for opening the grippers at a distribution station, and means acting as an abutment for those parts of the sheet which are located between the gripped folds during the advance of said parts of the sheet along at least part of the said track between the said stations.

Figure 1:
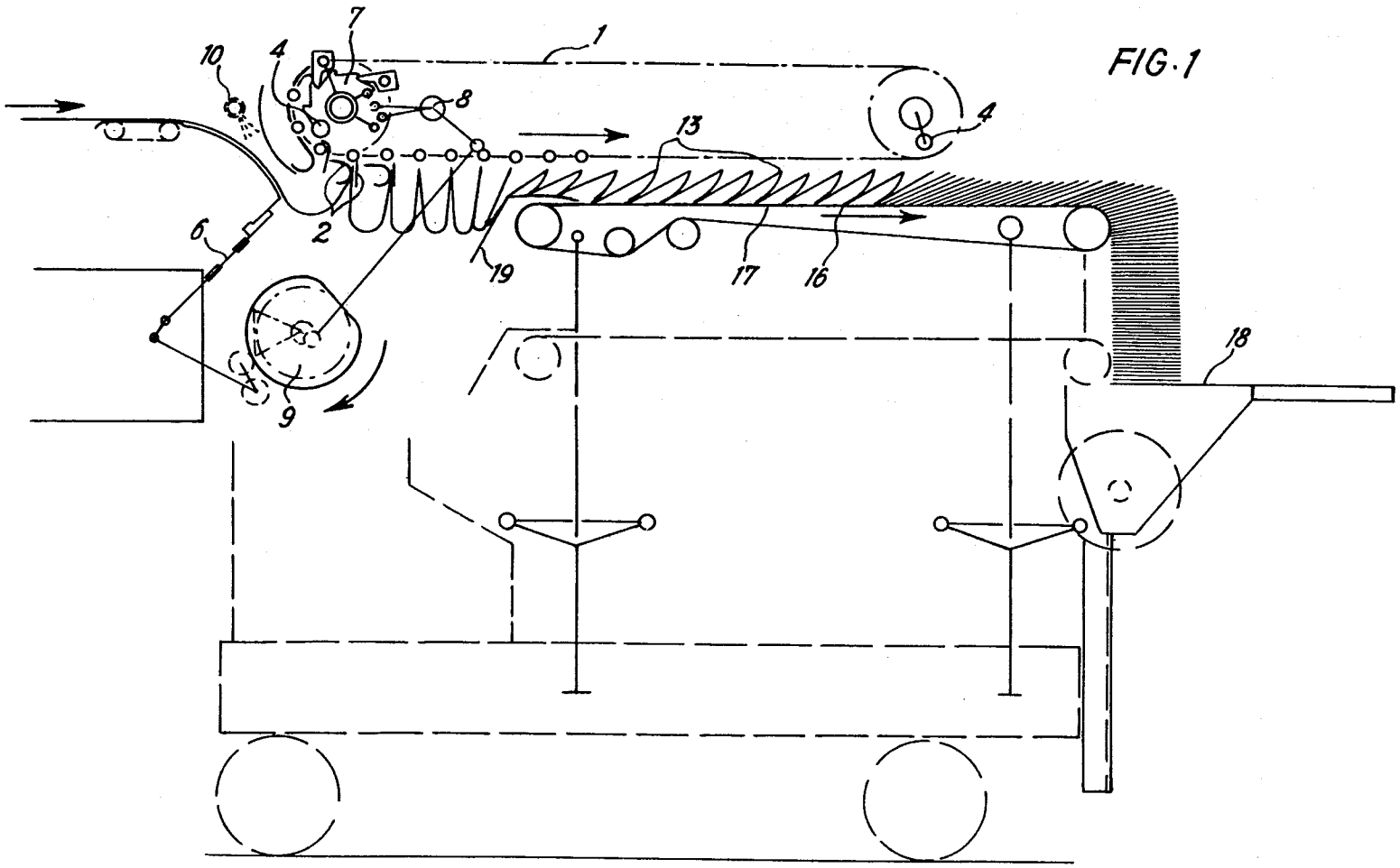
Figure 2:
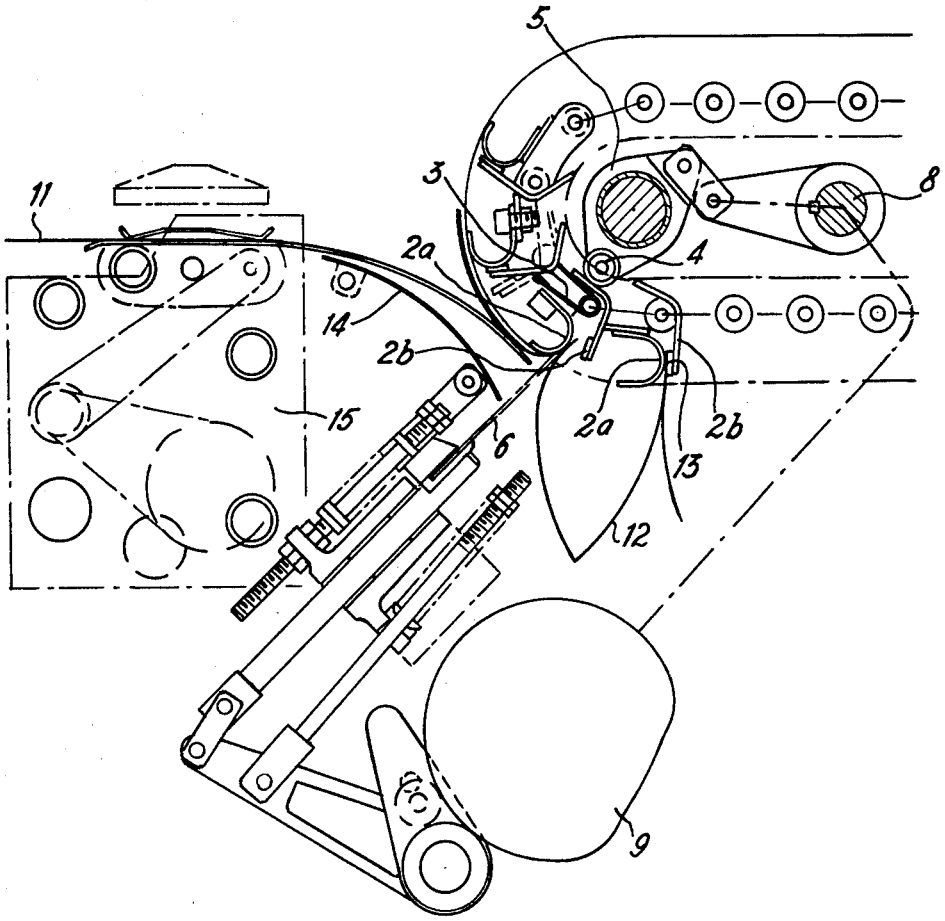

The invention will now be described by way of example with reference to the accompanying drawings, in which:

FIG. 1 is a diagrammatic view in side elevation of a folding apparatus according to this invention, and FIG. 2 is a similar view on an enlarged scale of a part of the apparatus embodying the folding mechanism thereof.

The folding apparatus shown in the drawings includes an endless conveyor chain 1 which carries a series of grippers 2. Some only of the grippers are illustrated in FIG. 1, but it will be understood that, in fact, the grippers are distributed regularly over the whole length of the endless conveyor chain.

Each gripper has two jaws 2*a*, 2*b* (FIG. 2) which are normally held applied against each other by means of a spring 3 (only one spring is shown in FIG. 2). Opening of the grippers is brought about by the action of a roller 4 which, in operation, engages one jaw 2*a* of each successive pair of jaws and acts thereon in a direction opposite to the direction of action of the spring. The roller 4 is mounted on a movable member 5.

A further roller 4, similar to the roller 4 carried by the movable member 5 is situated at the other end of the track of the endless conveyor chain, as is shown diagrammatically in FIG. 1.

The jaws 2*a*, 2*b* of each gripper extend across the entire width of a sheet 11 to be folded and one or each of said jaws is provided along its gripping surface with a series of teeth.

A blade 6, provided along its upper edge with a series of teeth complementary to the teeth on the gripper jaws, is arranged at right angles to the sheet 11.

This blade 6 is mounted to be displaceable, in directions substantially parallel to its main surfaces, towards and away from a sprocket wheel 7 which drives the endless chain 1 and which is located at one end of the two main runs of the latter.

A driving mechanism (not shown) ensures, in a coordinated manner, a stepwise advance of the endless chain 1, a reciprocating movement of the blade 6, and the movement of the two rollers 4.

During each folding cycle, the endless chain 1 advances by one step through a distance corresponding to the distance between two successive grippers and one of the grippers comes to rest in the open position exactly opposite the blade 6.

The sheet to be folded is supplied, with or without tension, by a feed device which, for example, may be a device operated by a discontinuous "stop and go" mechanism. This device is fitted with a registration adjustment mechanism 15 whereby the positions at which fold lines, defined by perforations or other transverse markings on the sheet 11, come to rest can be advanced or retarded.

The blade 6 is controlled in such a way that the movements thereof in the direction to engage the sheet 11 within each successive open gripper are made during the cessation of feed of the said sheet.

The above-mentioned driving mechanism may, as shown diagrammatically in the drawings, include a driving shaft 8 which firstly drives a pawl and ratchet gear 7 whereby the endless chain 1 is advanced stepwise, secondly drives a cam 9 whereby reciprocating movement is imparted to the blade 6 and thirdly drives two linkages (one of which is shown in FIG. 2) whereby movement is imparted respectively to the member 5 carrying the roller 4 at the left-hand end of the apparatus, as seen in FIG. 1, and to a like member carrying the roller 4 at the right-hand end of the apparatus.

A blower 10, located on the input side of the fold-forming station, which is defined by the blade 6 and the gripper opposite thereto during each pause in the advance of the endless chain 1, is arranged to blow air against the sheet 11 in a direction to extend the latter and thereby to favor the formation of an ogival loop 12 therein after each fold 13.

A convex surface of a curved guide plate 14 directs the sheet towards the gap formed between the blade 6, when the latter is retracted, and the path followed by the grippers as they are advanced past the blade 6.

The folding cycle includes the following steps:

1. By means of the registration adjustment mechanism 15, the feed of the sheet 11 is adjusted so that a transverse perforation comes to rest opposite the blade 6. The blade 6 then introduces the sheet 11 into the gripper which has been brought to rest opposite the said blade and has been opened by the roller 4 which is at the left-hand end of the apparatus as seen in FIG. 1. The jaws *2a, 2b* of the gripper are now allowed to close while the blade 6 is still in its fully advanced position.

2. Next, the blade 6 is withdrawn, leaving a space between the toothed edge and the gripper.

3. The feed mechanism then causes the sheet 11 to advance through a distance equal to two formats. By means of the blower 10 an ogival-shaped loop is formed in the sheet to provide for the formation of a fold in the opposite direction to the fold just formed.

4. During the forward movement of the sheet 11, the driving mechanism of the endless chain 1 causes this chain to move forward through one step in such a way that a new gripper is presented opposite the blade 6.

5. The folding cycle is now complete and is subsequently repeated in an identical manner.

The operations described above relate mainly to the positive formation of the upwardly directed folds 13 as seen in FIG. 1.

The downwardly directed folds 16 shown in FIG. 1 are obtained by the compression of the sheet against a travelling belt 17 during the advance movements of the endless chain 1 with the upwardly directed folds 13 held in the grippers.

The belt 17, which is composed of webbing moves at a slow speed in the direction of the arrow shown in FIG. 1 towards a table 18 for the reception of the folded pages. The speed of translation of the belt 17 must be less than the speed of movement of the endless chain 1. The belt 17 ensures the retention of the folds transported by grippers on the chain 1 and forces the loops of the sheet to flatten out to form the required downwardly directed folds 16, the upwardly directed folds 13 being produced as described above by the blade 6. In the embodiment illustrated, a deflector 19 of sheet metal is arranged so as to partly cover the left-hand end, as seen in FIG. 1, of the belt 17 in order to assure that the movement of the said belt will not disturb the arrangement of the upwardly directed folds 13.

In this way the endless chain 1 which carries the grippers transports the loops of paper towards the belt 17. The loops 12 abut on the belt 17 and flatten out against each other so that a downwardly directed fold forms naturally along each transverse perforation in the sheet 11.

The relative movements of the grippers and the belt 17 are such as to cause the folds produced to flatten out on this belt.

After being advanced through a certain distance, the grippers are opened by the roller 4 at the right-hand end of the apparatus as seen in FIG. 1, so as to release the folded sheet completely on to the belt 17.

Because of its movement of translation, the belt 17 discharges successive folded portions of the sheet onto the table 18 where the operator can service the product.

In order to change the format of folding, it is thus sufficient, as will be understood, to adjust the formation of the upwardly directed folds, which can be done very easily by adjusting the drive for the grippers and the blade.

I claim:

1. In a method of folding an elongate web to form the same into pages, the steps of:

(a) forming a series of first folds, to be located along respective first edges of the pages, by successively gripping parts of said web at intervals along its length;

(b) imparting a reversed ogival form to intermediate parts of said web between the said first folds;

(c) advancing the said first folds at a first speed while laying said intermediate parts of said web on a conveyor moving substantially parallel to, and at a second speed less than said first speed, so as to form intermediate folds along respective second edges of the pages opposite said first edges.

2. A method as claimed in claim 1, wherein the fold lines of said first folds are horizontal and the loops are formed at least partly by the action of gravity on said intermediate portions of the web.

3. A method as claimed in claim 2, wherein the formation of said loops is assisted by blowing air downwardly onto each successive intermediate portion of the web.

4. A method as claimed in claim 1, wherein both the gripping of each successive sheet portion to form a respective first fold therein and the formation of an adjoining intermediate sheet portion into a loop take place during a corresponding pause in the advance of the web.

5. An apparatus for folding an elongate web to form the same into pages, comprising:

(a) a series of grippers;

(b) means for advancing said grippers along an endless track having a fold-forming station and a delivery station at successive positions long its length;

(c) means for opening said grippers at said fold-forming station;

(d) means for inserting parts of said web into said grippers in a first direction while said grippers are open at said fold-forming station;

(e) means for closing said grippers onto said web parts so as to form first folds therein;

(f) means for opening the grippers at said delivery station; and (g) a conveyor acting as an abutment for said intermediate parts of said web between said first folds during the advance of said intermediate parts along at least part of the distance between said fold-forming station and said delivery station while said grippers are closed onto said web parts and are being correspondingly advanced by said advancing means;

(h) said conveyor having a conveyor run extending parallel to the path of said grippers between said fold-forming station and said delivery station, and means being provided for driving said conveyor so that the conveying run thereof advances toward said delivery station at a speed lower than the speed of said grippers when advanced by said gripper-advancing means.

6. An apparatus as claimed in claim 5, wherein means are provided for feeding said elongate web lengthwise to said fold-forming station.

7. An apparatus as claimed in claim 5, wherein said means for advancing said grippers is arranged to advance them step-by-step and said web-inserting means, said gripper-closing means and said gripper-opening means at said delivery station are arranged to operate during pauses in the step-by-step advance of said grippers.

8. An apparatus as claimed in claim 5, wherein means are provided at the fold-forming station for directing a stream of air onto each successive intermediate part of the web in a direction substantially opposite to the direction of insertion of the web parts into the grippers, so as to favor the formation of each successive intermediate portion of the web into a loop.

* * * * *